United States Patent [19]

Backhouse et al.

[11] Patent Number: 4,755,820

[45] Date of Patent: Jul. 5, 1988

[54] ANTENNA DEVICE

[75] Inventors: Paul M. Backhouse; Norman Apsley; Huw D. Rees, all of Worcester, England

[73] Assignee: The Secretary of State for Defence in Her Britannic Majesty's Government of the United Kingdom of Great Britain and Northern Ireland, London, England

[21] Appl. No.: 892,427

[22] Filed: Aug. 4, 1986

[30] Foreign Application Priority Data

Aug. 8, 1985 [GB] United Kingdom ..... 8519900

[51] Int. Cl.[4] ..... H01Q 1/32

[52] U.S. Cl. ..... 343/700 MS; 343/753; 343/872

[58] Field of Search ..... 343/700 MS, 872, 873, 343/753, 909, 754, 911 R

[56] References Cited

U.S. PATENT DOCUMENTS

| | | | |
|---|---|---|---|
| 4,012,741 | 3/1977 | Johnson | 343/700 MS |
| 4,072,952 | 2/1978 | Demko | 343/700 MS |
| 4,490,721 | 12/1984 | Stockton et l. | 343/700 MS |
| 4,600,018 | 7/1986 | James et al. | 343/700 MS |
| 4,654,622 | 3/1987 | Foss et al. | 343/700 MS |

FOREIGN PATENT DOCUMENTS

| | | | |
|---|---|---|---|
| 2131232 | 6/1984 | United Kingdom | 343/700 MS |

*Primary Examiner*—William L. Sikes
*Assistant Examiner*—Hoanganh Le
*Attorney, Agent, or Firm*—William R. Hinds

[57] ABSTRACT

An antenna device comprises a dielectric sheet substrate having an antenna patch on one surface and a ground plane on the other surface. A hemispherical dielectric lens is arranged over the antenna patch in intimate contact with it. The substrate and the lens are of low and high permittivity material respectively. The lens couples the antenna patch radiation away from the substrate. This avoids the inefficiency arising from power trapping in the substrate of a prior art microstrip patch antenna. The antenna device radiates into a comparatively narrow cone axially perpendicular to the antenna patch, and coupling of radiation from a power source to free space can theoretically be 100%. The antenna impedance is a function of its structural geometry, and is easily designed for impedance matching to a power source.

8 Claims, 6 Drawing Sheets

5mm PATCH ANTENNA DRIVEN AT END h = 0.54mm 8GHz

4mm ANTENNA DRIVEN AT ONE END

7GHz

H-PLANE RADIATION PATTERN DUE TO VERTICAL CURRENT FEED

ANTENNA DEVICE

FIELD OF THE INVENTION

This invention relates to an antenna device of the kind used to radiate the output of an electromagnetic power source into free space.

BACKGROUND OF THE INVENTION

Antenna devices are known. These include wire antennae and waveguide horns. An antenna is driven by a power source via an impedance matching network. The network is required because typical solid state power sources such as Gunn or impatt diodes have impedances much lower than that of a wire antenna or waveguide horn. The matching network is not incorporated monolithically in the solid state power source structure since this is not necessarily technically feasible and is wasteful of valuable semiconductor material in any event Antenna devices are accordingly usually of hybrid form. However, the reactance of the power source is then a function of bond wire connections and the like. The result is that solid state power sources require individual manual adjustment. At higher frequencies in particular, matching requires the use of waveguide cavities which are heavy and bulky relative to the power source or antenna. Moreover, the required degree of mismatch reduction reduces power amplifier bandwidth.

To avoid the need for an impedance matching network, microstrip patch antennae have been developed. Such an antenna typically consists of a planar rectangular patch of metal on one surface of a dielectric substrate sheet, the other surface bearing a ground plane. The antenna impedance can be arranged to allow a power source to be integrated directly into the antenna structure without an intervening matching network. However, it is found that radiative efficiency is low and bandwidth severely limited for such an antenna as compared to conventional types. Radiative efficiency is low because much of the energy radiated by a patch antenna of known kind is trapped within the substrate layer, and only a small proportion is radiated into free space. Similar effects have been analysed by Brewitt-Taylor, Gunton and Rees in Electronics Letters, 1st Oct. 1981, Vol 17, pp 729–731.

It is an object of the invention to provide an alternative form of antenna device.

FEATURES AND ASPECTS OF THE INVENTION

Generally, the present invention provides an antenna device comprising a conducting antenna patch spaced from a conducting ground plane by the thickness of a dielectric sheet, means for energizing the antenna patch, and a low-loss dielectric coupling member arranged over the antenna patch to couple radiation from it away from the dielectric sheet, and coupling member having a dielectric constant at least twice the dielectric constant of the sheet, and having a cross-sectional area reducing with distance from the antenna patch.

The term "ground plane" is herein employed in accordance with its ordinary signification in the art as meaning a normally but not necessarily flat conducting sheet for earthing purposes.

It has been discovered that the invention provides an antenna device capable of coupling power from a source to free space with higher efficiency than a prior art microstrip patch antenna device. In particular, radiation trapping in the dielectric sheet is avoided. In addition, as will be described, the invention is characterised by design geometry features such as dielectric sheet thickness which can easily be selected to provide impedance matching of the antenna device to a power source. There is therefore no need for a matching network. The invention accordingly provides the efficiency of conventional wire antennae, waveguide horns and matching networks combined with the ease of construction of prior art microstrip patch antennae.

In a preferred embodiment, the antennae device is arranged to be at or above quarter wavelength resonance; the means for energising the patch antenna comprises a power source connected to one longitudinal end of the patch. In this embodiment, the device may have a dielectric coupling member in the form of a lens. This provides an antenna radiation pattern substantially in the form of a relatively narrow cone centred on the antenna boresight, which is particularly advantageous in use.

The antenna patch may conveniently be a planar and rectangular metal element. The said at least one dielectric element may be a plurality of elements, but is conveniently a single sheet of low loss material. It may be plastics material of dielectric constant in the region of 2.5. The dielectric coupling member preferably has a dielectric constant of more than twice, and preferably at least three times that of the sheet, and may be of alumina with dielectric constant 9.8. The means for energising the antenna patch may be a discrete solid state device arranged between the ground plane and patch and accommodated within the dielectric sheet. Such means may alternatively be a coaxial power connection made through a hole in the ground plane and passing via the dielectric sheet.

The dielectric sheet may be of high resistivity and hence low loss semiconductor material into which a solid state power source is integrated. The semiconductor material may be Si, in which case the coupling member may be barium nona-titanate with a dielectric constant of 36.

The antenna device may be provided with focussing means to produce a parallel output beam. Alternatively, the dielectric coupling member may have a tapering cross-section suitable for launching radiation into a waveguide.

The antenna device of the invention may be arranged with other like devices to form an array.

BRIEF DESCRIPTION OF THE DRAWING

In order that the invention might be more fully understood, embodiments thereof will now be described, by way of example only, with reference to the accompanying drawings, in which.

DESCRIPTION OF THE PREFERRED EMBODIMENTS

Figure 1:
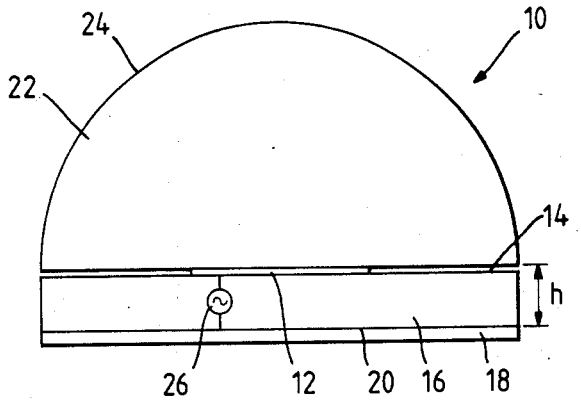
FIG. 1 schematically shows an antenna device of the invention.

Referring to FIG. 1, there is shown a sectional view of an antenna device of the invention indicated generally by 10. The device consists of a planar and rectangular metal conductor or antenna patch 12 arranged horizontally on one surface 14 of a dielectric sheet substrate 16. The width dimension of the patch 12 is perpendicular to the plane of the drawing. A metal ground plane 18 is disposed on the other surface 20 of the substrate 16. The substrate 16 is of proprietary material designated "Plastikard", and manufactured by Slater's Plastikard Ltd, a British Company. It has low loss and low permittivity. The substrate 16 may alternatively be of polytetrafluorethylene (PTFE) of dielectric constant 2.1. A hemispherical dielectric lens 22 having a curved surface 24 is arranged over and in intimate contact with the antenna patch 12. The lens 22 is of alumina having a dielectric constant of 9.8. A microwave power source indicated generally by 26 is connected between the patch 12 and ground plane 18 through the substrate 16, as will be described later in more detail.

The antenna device 10 operates as follows. Since the lens 22 is of higher dielectric constant than the substrate 16, radiation from the antenna patch 12 is coupled predominantly into the lens 22 away from the substrate 16. Moreover, the lens 22 has a focussing effect which directs the radiation as a beam into free space beyond the surface 24. The result is that power from the source 26 is radiated into free space with greater efficiency than is possible with a prior art microstrip patch antenna, since power is predominantly coupled away from the substrate 16 to which radiation is lost in the prior art.

Figure 2:
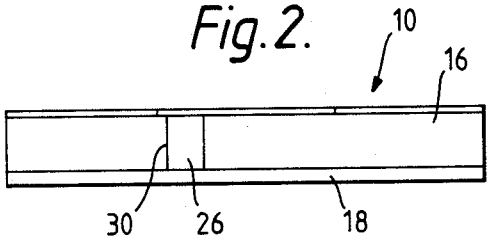
FIGS. 2 and 3 are side and plan views of part of the FIG. 1 device illustrating power source provision.
Figure 3:
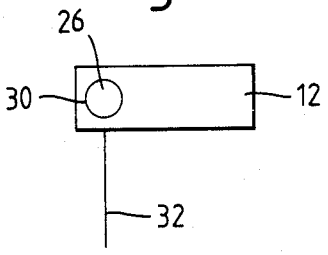

Referring now to FIGS. 2 and 3, in which parts previously mentioned are like referenced, there are shown respectively side and plan elevations of parts of the device 10 illustrating power source mounting. As illustrated, the substrate 16 has a hole 30 to accommodate a discrete solid state power source 26 such as a Gunn diode or an impatt diode. The diode power source 26 is provided with DC bias relative to the ground plane !8 via a connection 32 to the antenna patch 12.

The dielectric sheet substrate 16 may be of low loss semiconductor material such as Si or GaAs into which a solid state power source 26 is integrated. For a substrate of Si with a dielectric constant of 12, an associated dielectric member or lens 22 of barium nona-titanate may be employed having a dielectric constant of 36.

Figure 4:
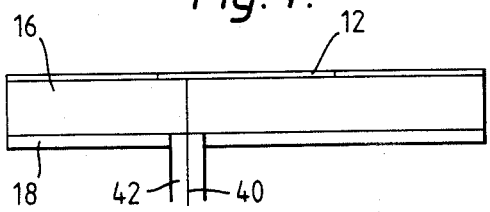
FIG. 4 illustrates a coaxial power connection for the FIG. 1 device.

Referring now to FIG. 4, in which parts previously mentioned are like referenced, there is illustrated power coupling or current feed to the antenna patch 12 via a coaxial line 40. The line 40 extends vertically, ie perpendicular to the plane of the patch 12. It passes through a hole 42 in the ground plane 18 and thence via the dielectric substrate 16 to the patch 12.

Impedance measurements have been made on the antenna device 10 as a function of drive position or power source connection point along the length of the antenna patch 12. Measurements were made using a coaxial feed as shown in FIG. 4 together with a network analyser. It has been found surprisingly that the condition for resonance is that the effective antenna length from the drive point is one quarter of a wavelength (or multiples thereof) at the interface between the two dielectrics 16 and 22. Moreover, the current in the antenna patch 12 runs outwards, ie away from the drive point in both directions along the patch. This is quite different to the situation in prior art patch antennae, in which current runs undirectionally from one end to the other and resonance occurs at an effective antenna length of one half of a wavelength irrespective of drive position.

Figure 6:
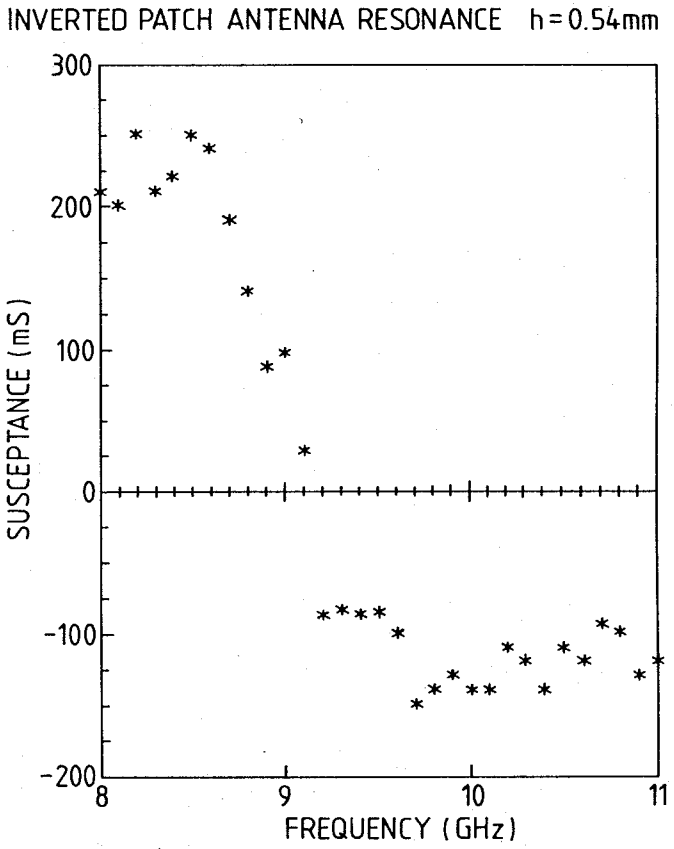
FIGS. 5 and 6 provide impedance data as a function of frequency for the FIG. 1 device.
Figure 5:
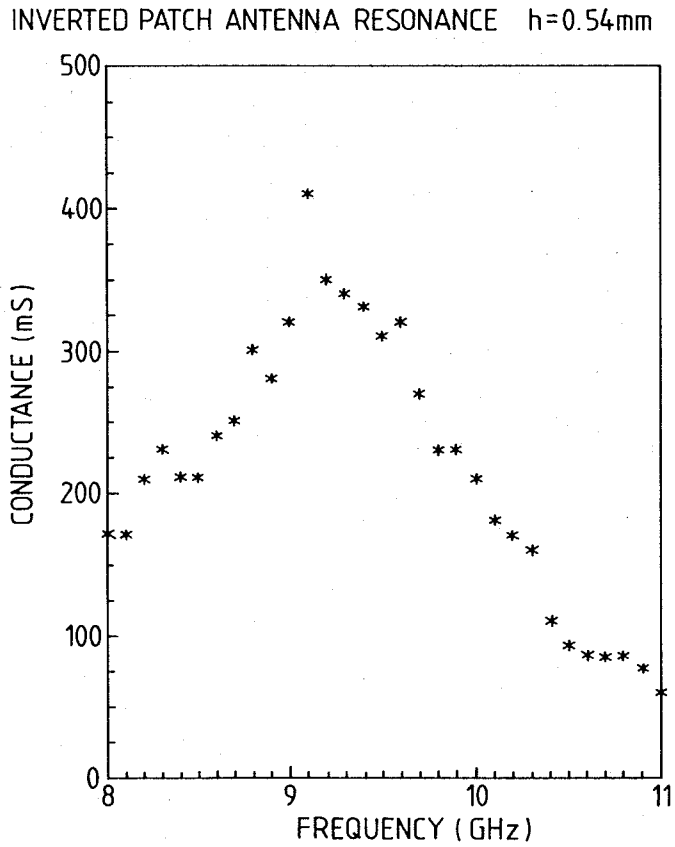

Referring now to FIGS. 5 and 6, there are shown respectively measurements of conductance and susceptance in milli-siemens (ms) plotted against frequency in GHz for an antenna device of the invention. The measurements were made on a device generally similar to that described earlier with reference to FIGS. 1 and 4, except that the hemispherical lens 22 was replaced by an alumina lens having a focal plane in which the antenna patch was located. Radiation passing through the lens was absorbed in water providing a non-reflecting lossy load. This avoids reflection back to the patch. The patch itself had a length of 3.5 mm and a width of 1 mm, and was connected at one end to a power source. The thickness h of the dielectric sheet between patch and ground plane was 0.54 mm. It can be seen that antenna resonance occurs at about 9.1 GHz. Further measurements (not illustrated) on antenna devices of the invention with different values of h indicate that resonant impedance varies linearly with h for h much less than a quarter of a wavelength. Impedance is expected to be a maximum when h is approximately a quarter of a wavelength, the impedance then having a value determined by antenna patch dimensions and the dielectric constants of the two adjacent media.

It can be seen from FIGS. 5 and 6 that the resonant antenna device impedance is only a few ohms. In particular, the reciprocal of the maximum measured conductance of about 400 ms at 9.1 GHz is 2.5 ohms. Moreover, as has been said, the resonant impedance can be altered by varying h, antenna dimensions and media dielectric constants. Since typical power source impedances are also of the order of a few ohms, it is straightforward to design antenna devices of the invention for impedance matching to power sources.

Figure 7:
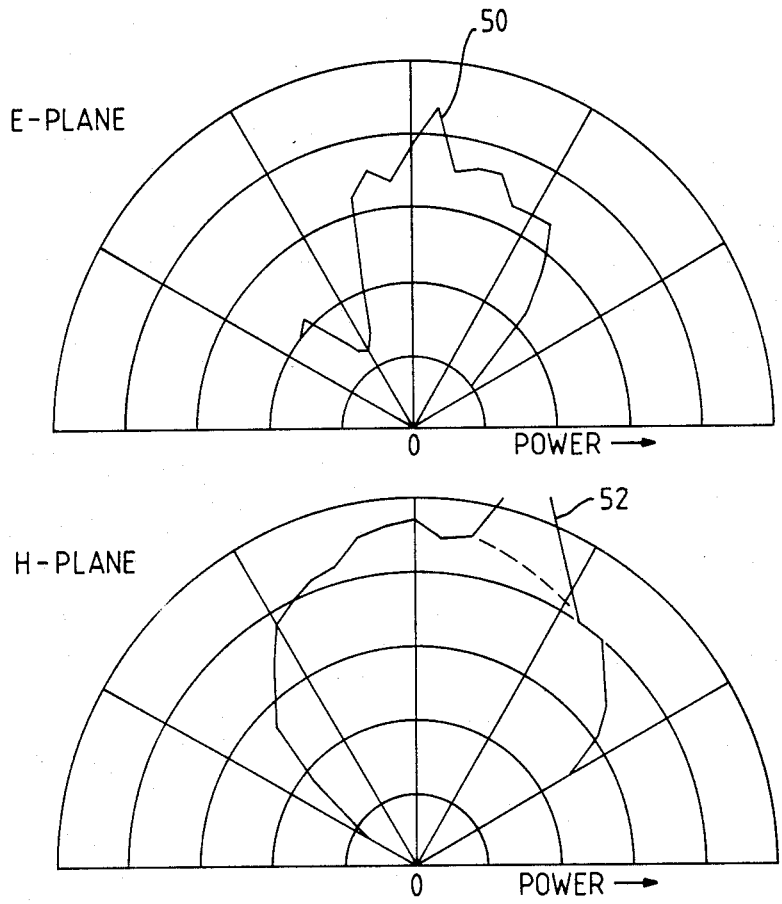
FIG. 7 provides measured output radiation patterns for the FIG. 1 device with power fed to one end of the antenna patch.

Referring now to FIG. 7, there are shown graphs 50 and 52 in polar coordinates of power (arbitrary units) radiated by an antenna device of the invention plotted as a function of angle. The graphs 50 and 52 relate to the E and H planes respectively, and extend upwardly of the plane of a corresponding horizontal antenna patch such as 12 in FIG. 1. The FIG. 7 data were obtained at 8 GHz using an arrangement generally similar to that of FIG. 1 with the vertical current feed shown in FIG. 4. Detail differences are as follows. A hemispherical lens similar to 22 was employed, but it was of a commercially available material designated PT9.8 and manufactured by Marcoi Electronic Devices Ltd, a British company. The lens curved surface had an antireflection coating. The antenna patch was 5 mm in length, and power connection was made at one end. It can be seen that radiation is directed into a comparatively narrow cone for both graphs 50 and 52. Graph 50 is asymmetric due to the effect of the antenna patch current feed which also radiates. Detection of this effect in the H-plane is avoided, because H-plane contributions from the current feed and antenna patch are polarised orthogonally to one another and can be detected separately.

Figure 8:
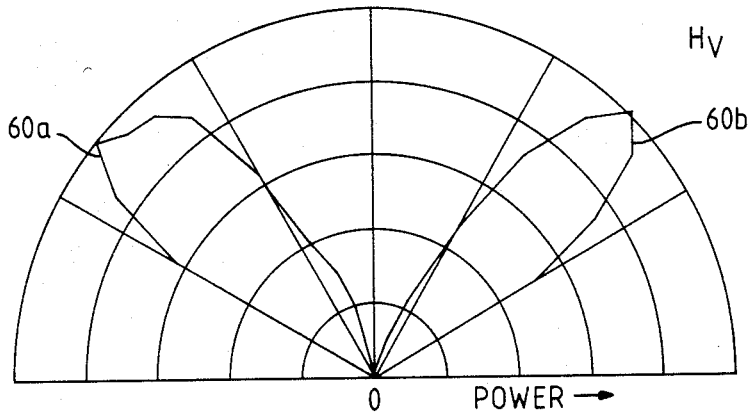
FIG. 8 illustrates the radiation pattern arising from a coaxial power connection.

Referring now to FIG. 8, there is shown a graph of radiated power as a function of angle in polar coordinates for a current feed to an antenna patch. The patch was 4 mm long, power connection was made to one end and measurements were made at 7 GHz in the H-plane. As has been mentioned, the H-plane current feed radiation is detectable independently of that from the antenna patch. The graph consists of two lobes 60*a* and 60*b* arranged substantially symmetrically about the vertical or boresight direction. The E-plane equivalent of the right-hand lobe 60*b* becomes combined with the antenna patch E-plane radiation to produce the asymmetry shown in graph 50 in FIG. 7. The E-plane equivalent of the left-hand lobe 60*a* is much weaker because of the blocking effect of the antenna patch, and does not make a significant contribution to the graph 50.

Figure 9:
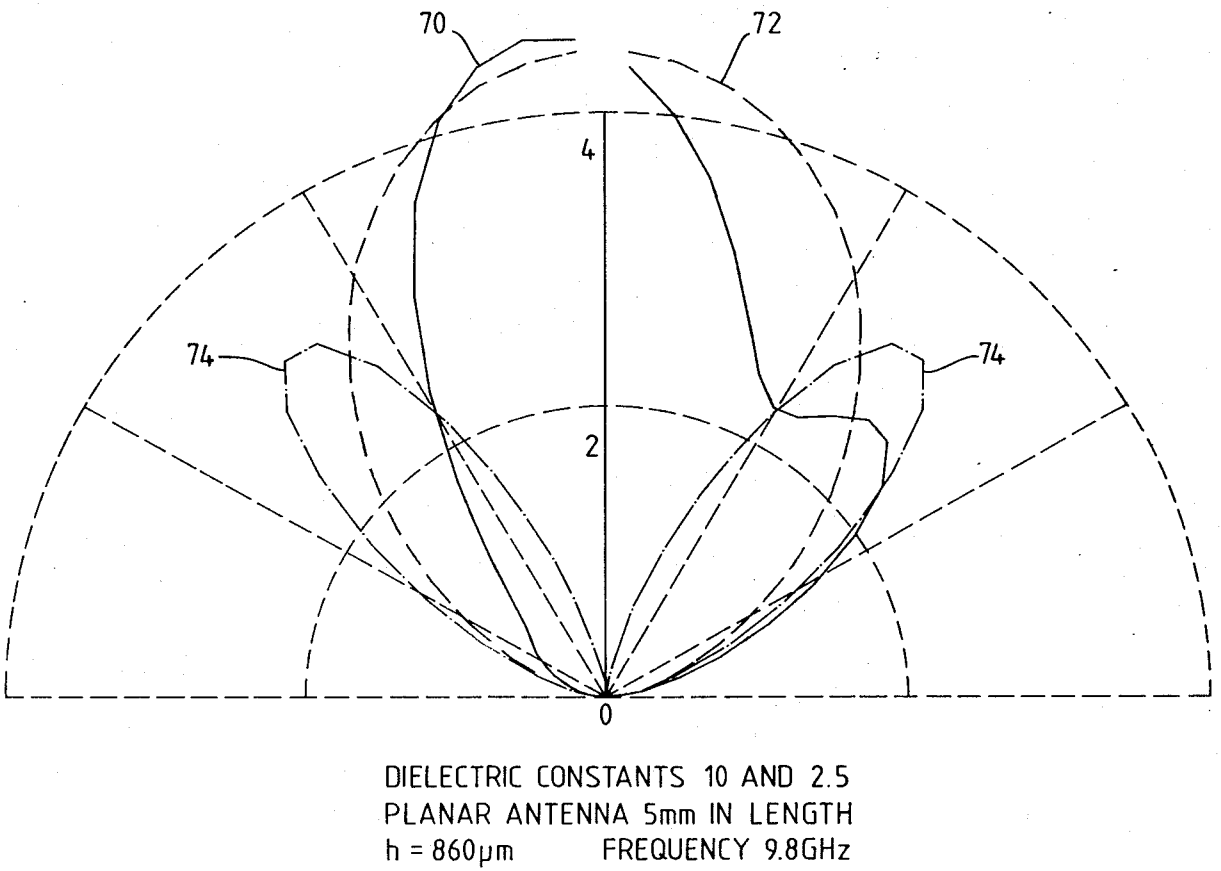
FIG. 9 provides theoretical radiation patterns for a device of the invention with power fed to one end of the antenna patch.

Referring now to FIG. 9, there is shown a theoretical radiation pattern for an antenna device of the invention. The pattern is calculated for a device as shown in FIG. 1 operating at 9.8 GHz, and to which power is fed at one end of the antenna patch. The device parameters employed were antenna patch length 5 mm, substrate thickness (h) 0.86 mm, and lens and substrate dielectric constants 10 and 2.5 respectively. The pattern includes an E-plane graph 70 (solid line) and an H-plane te graph 72 (broken line). Graph 74 shows the H-plane tm pattern (chain line). The calculated antenna radiation pattern indicates output into a comparatively narrow cone in agreement with the measurements discussed previously. It will be noted that the antenna radiation pattern intensity is zero in the (horizontal) plane of the antenna patch.

Figure 10:
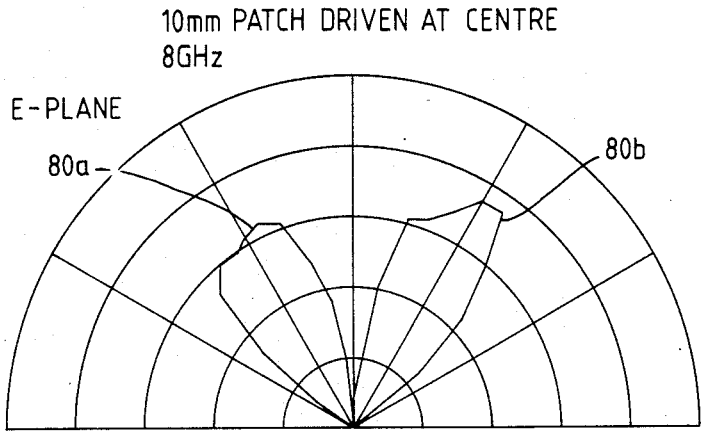
FIG. 10 illustrates the measured radiation pattern obtained from a device of the invention when power is fed to the centre of the antenna patch.

Referring now to FIG. 10, there is shown a further radiation pattern illustrating the effect of power connection to the centre of an antenna patch of the invention. Power measurement was carried out at 8 GHz in the E-plane using an antenna patch 10 mm in length. The radiation pattern consists of two narrow lobes 80*a* and 80*b* arranged fairly symmetrically about boresight, at which there is a null. The null occurs since currents run outwards from the power connection point at the centre of the antenna patch, and the two ends of the patch are radiating in antiphase. This is quite different to conventional microstrip patch antennae, in which currents run along the patch independently of the power connection position.

Figure 11:
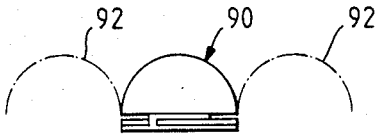
FIG. 11 schematically shows an antenna device of the invention appropriate for forming part of an array.
Figure 12:
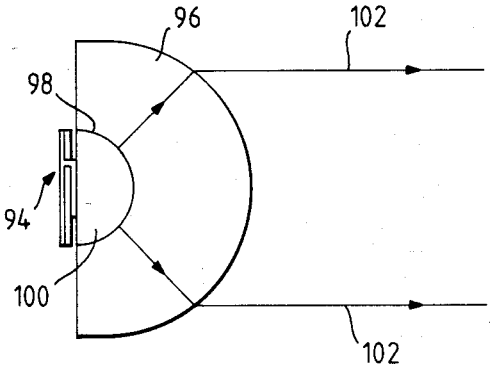
FIGS. 12 and 13 illustrate parallel output beam production from a device of the invention.

Referring now to FIGS. 11 to 14 inclusive, there are schematically illustrated various implementations of antenna devices of the invention each similar to that shown in FIG. 1. In FIG. 11, an antenna device 90 is shown arranged to radiate into free space. The device 90 may be used either alone or accompanied by equivalent devices (indicated by chain lines 92) to form an array. In FIG. 12, a device 94 is shown furnished with an additional dielectric lens 96 of concavo-convex form The lens 96 has an inner concave surface 98 complementary to and in contact with the lens 100 of the device 94. The lenses 98 and 100 form a multiple component lens which produces a parallel output beam from the device 94 as indicated at 102.

Figure 13:
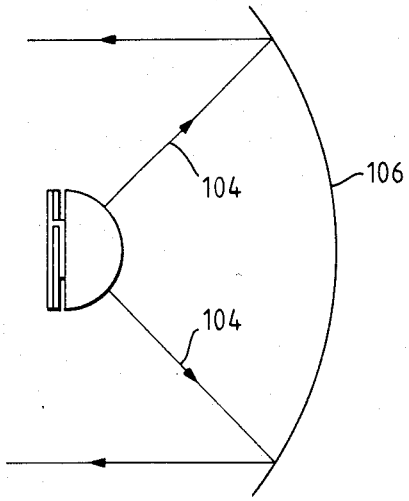

As shown in FIG. 13, the device output 104 may alternatively be rendered parallel using a mirror 106.

Figure 14:
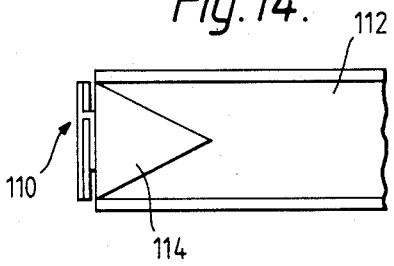
FIG. 14 illustrates use of the invention to launch radiation into a waveguide.

FIG. 14 shows a sectional view of an antenna device 110 arranged as a launcher to input radiation to a waveguide 112. In this embodiment the device 10 has a tapering dielectric coupling member 114 for coupling radiation from the antenna patch to the waveguide. This member 114 replaces the hemispherical lens of earlier embodiments. For a cylindrical waveguide, the cross-section of the coupling member 114 perpendicular to the plane of the drawing is circular. For a rectangular waveguide this section is rectangular.

In summary, the invention provides an antenna device characterised by ease of construction and impedance matching to a power source, high efficiency and advantageous output radiation pattern. The efficiency of coupling a power source to free space is theoretically 100%. In comparison, a prior art microstrip patch antenna is at best about 70% efficient when a low permittivity dielectric substrate is used for the antenna patch. If a silicon substrate were to be used in order to incorporate within it an integrated power source, the efficiency would fall to around 20%. This is because radiation is trapped in the substrate of the prior art device. This results in power loss to the substrate to a degree varying with substrate dielectric constant. Furthermore, the prior art device is unsuitable for use as a member of an array. Coupling between adjacent devices would occur, because each radiation pattern does not fall to zero in the plane of the antenna patch, unlike the invention. Moreover, coupling via the substrate would occur in a prior art array on a common substrate. In contrast, the invention radiates away from the plane of the antenna patch into a comparatively narrow cone from which a substantially parallel output beam can easily be produced. In addition, a semiconductor antenna patch substrate may be employed and a power source integrated therein. Since radiation output is zero in the plane of the antenna patch, the invention is ideally suited to producing arrays of antenna devices which do not couple together.

We claim:

1. An antenna device including a dielectric sheet having two surfaces separated by the sheet thickness dimension, a conducting ground plane disposed on one sheet surface, a conducting antenna patch disposed on the other sheet surface, means for energising the antenna patch, and a low-loss dielectric coupling member arranged over the antenna patch to couple radiation therefrom away from the dielectric sheet, the coupling member having a dielectric constant at least twice that of the sheet and having a cross-sectional area reducing with perpendicular distance from the antenna patch.

2. An antenna device according to claim 1 wherein the coupling member has a circular cross-section reducing in diameter with distance from the antenna patch.

3. An antenna device according to claim 1 wherein the coupling member is hemispherical.

4. An antenna device according to claim 3 including focussing means arranged to render parallel radiation from the antenna patch received via the coupling member.

5. An antenna device according to claim 1 wherein the coupling member is of tapering cross-section and is arranged to launch radiation from the antenna patch into a waveguide of like cross-sectional shape.

6. An antenna device according to claim 1 wherein the dielectric sheet is of plastics material and the coupling member is of ceramic material.

7. An antenna device according to claim 1 wherein the dielectric sheet is of semiconductor material.

8. An antenna device according to claim 7 wherein the means for energising the antenna patch is a solid state device integrated in the dielectric sheet.

* * * * *